US006563266B2

(12) United States Patent
Ok et al.

(10) Patent No.: US 6,563,266 B2
(45) Date of Patent: May 13, 2003

(54) AC TYPE PLASMA DISPLAY PANEL FOR BACK LIGHT OF LIQUID CRYSTAL DISPLAY DEVICE

(75) Inventors: Do Young Ok, Kyoungki-do (KR); Jun Ho Lee, Seoul (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 0 days.

(21) Appl. No.: 09/993,000

(22) Filed: Nov. 6, 2001

(65) Prior Publication Data

US 2002/0060519 A1 May 23, 2002

(30) Foreign Application Priority Data

Nov. 22, 2000 (KR) ..... 2000-0069666

(51) Int. Cl.[7] ..... H01J 17/49

(52) U.S. Cl. ..... 313/582; 313/583; 313/584; 313/586

(58) Field of Search ..... 313/582, 583, 313/584, 586

(56) References Cited

FOREIGN PATENT DOCUMENTS

| | | |
|---|---|---|
| JP | 5206157 | 8/1993 |
| JP | 7276046 | 10/1995 |
| JP | 0116448 | 5/1998 |

*Primary Examiner*—Vip Patel
(74) *Attorney, Agent, or Firm*—Ladas & Parry

(57) ABSTRACT

Disclosed is an AC type plasma display panel for back light of liquid crystal display device. The disclosed comprises a rear substrate and a front substrate arranged opposite to each other with a predetermined distance; seal paste for sealing the edges of the substrates; a pair of discharge electrodes interposed between the rear substrate and the front substrate, having a plurality of holes and separated with a predetermined distance in a state of no contact with the substrates; and a plurality of spacers interposed between the rear substrate and discharge electrodes and between the front substrate and discharge electrodes in order to maintain distances.

6 Claims, 2 Drawing Sheets

AC TYPE PLASMA DISPLAY PANEL FOR BACK LIGHT OF LIQUID CRYSTAL DISPLAY DEVICE

BACKGROUND OF THE INVENTION

1. Field of the Invention

The present invention relates to liquid crystal display device, and more particularly, to AC type plasma display panel for back light capable of realizing high brightness and being free from pollution due to mercury (Hg).

2. Description of the Related Art

Compared with Cathode-ray tube (CRT), a liquid crystal display device generally has advantages of light weight, thin thickness and low power consumption and therefore, it has been substituted for the CRT in a terminal of information system and video unit, etc. And recently, the liquid crystal display device has realized wide viewing angle and is prevented a color shift, thereby obtaining high quality screen. Therefore, it is widely used in a notebook PC and a computer monitor market. In addition, it is used in TV.

The liquid crystal display device cannot emit light by oneself differently from the CRT, so that back light unit is additionally included therein as a light source. The back light unit comprises a lamp as a practical light source, a light guide plate and a plurality of optical sheets, wherein the lamp is generally a fluorescent lamp.

However, there are limitations in employing the fluorescent lamp using mercury (Hg) due to pollution problem. Moreover, it is required that the light guide plate have a predetermined thickness in order to improve uniformity and brightness of light from the fluorescent lamp, so that the light guide plate functions as a cause increasing the thickness of liquid crystal display device. As a result, it is difficult to use the conventional back light unit having the above structure as the light source in the future.

Therefore, it has been proposed a technique that plasma display panel is used as a light source in order to prevent pollution due to Hg and to decrease the thickness of liquid crystal display device.

The plasma display panel is a kind of display devices and generally has a complicated structure. However, as shown in FIGS. 1 to 3, the plasma display panel for back light has a structure that a rear substrate 2 and a front substrate 4 comprising a pair of discharge electrodes 3*a*, 3*b*, 3*c* are sealed by seal paste 5 with discharge gas (not shown) filled. Herein, FIG. 1 shows an opposite discharge type plasma display panel and FIGS. 2 and 3 show surface discharge type plasma display panel.

The conventional plasma display panel for back light has advantages of realizing thin thickness of liquid crystal display device without pollution due to Hg. However, gas discharge is not sufficiently generated in the discharge space, thereby lowering the brightness. As a result, it is difficult to realize high quality screen in the liquid crystal display device having plasma display panel for back light.

SUMMARY OF THE INVENTION

Therefore, an object of the present invention is to provide AC type plasma display panel for back light capable of realizing high brightness.

In order to accomplish the above object, AC type plasma display panel according to the present invention comprises a rear substrate and a front substrate arranged opposite to each other with a predetermined distance; seal paste for sealing the edges of the substrates; a pair of discharge electrodes interposed between the rear substrate and the front substrate, having a plurality of holes therein and arranged with a predetermined distance from each other in a state of no contact with the substrates; and a plurality of spacers interposed between the rear substrate and discharge electrodes and between the front substrate and discharge electrodes in order to maintain distances.

The rear substrate is generally an aluminum substrate having excellent reflexibility or a glass substrate coated a reflective film. And, the front substrate is generally a glass substrate and a fluorescent layer is coated on the inner side thereof.

The discharge electrode is made of one metal plate selected from a group comprising aluminum, chrome, copper and nickel and the fabrication method thereof comprises the steps of: forming a plurality of holes in a metal plate by using a punching process; dividing the metal plate having a plurality of holes into two; forming thin dielectric layers on the surface of the divided metal plates by using an anodizing process; and fixing the metal plates between the rear substrate and the front substrate with a predetermined distance in a state of no contact with the substrates. In order to fix the pair of metal plates, outside sealing silicon rubbers having shapes of '⊂' and '⊃' are put in on the edges of the metal plates and then they are fixed on the rear substrate by printing.

The above objects, and other features and advantages of the present invention will become more apparent after reading the following detailed description when taken in conjunction with the drawings.

DETAILED DESCRIPTION OF THE INVENTION

Figure 1:
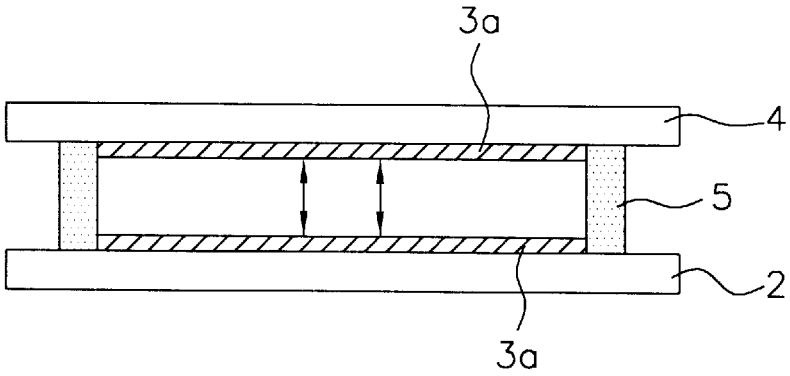
FIG. 1 (PRIOR ART)
FIGS. 1 to 3 are cross sectional views for showing opposite discharge type and side discharge type plasma display panels for back light according to the prior art.
Figure 2:
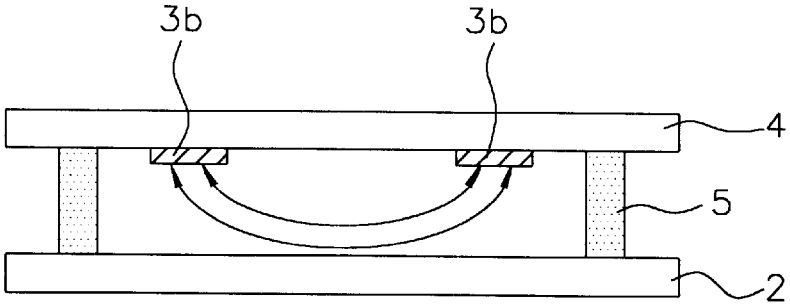
FIG. 2 (PRIOR ART)
Figure 3:
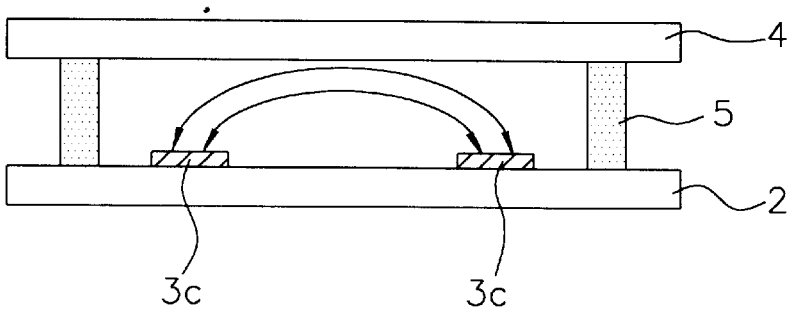
FIG. 3 (PRIOR ART)
Figure 4:
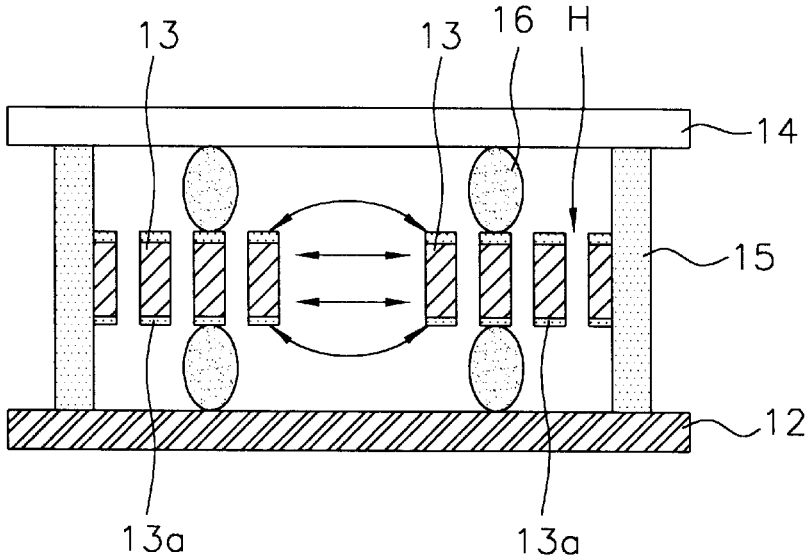
FIG. 4 is a cross sectional view for showing AC type plasma display panel for back light according to the present invention.
Figure 5:
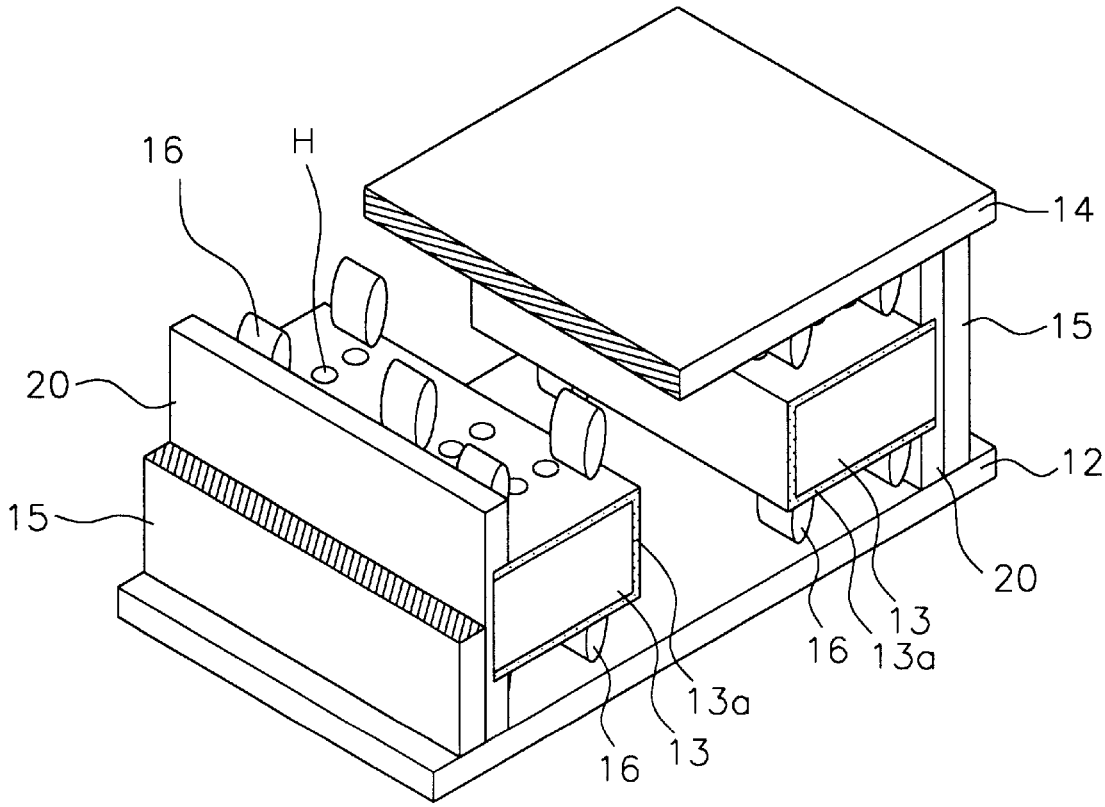
FIG. 5 is a drawing for showing AC type plasma display panel for back light according to an embodiment of the present invention.

Referring to FIGS. 4 and 5, a rear substrate 12 and a front substrate 14 are arranged opposite to each other with a predetermined distance. A pair of discharge electrodes 13 is arranged between the rear substrate 12 and the front substrate 14 with predetermined distances in a state of no contact with the substrates 12, 14. A plurality of spacers 16 are interposed between the rear substrate 12 and the discharge electrodes 13 and between the front substrate 14 and the discharge electrodes 13 in order to maintain the distances them respectively. And, the edges of the rear substrate 12 and the front substrate 14 are sealed with seal paste 15 and discharge gas (not shown) is filled in the space between the substrates 12, 14, sealed with the seal paste 15.

The rear substrate 12 is desirably an aluminum substrate having improved reflexibility or a glass substrate having a reflective film. The front substrate 14 is desirably a glass substrate in order to transmit light. And, white luminous fluorescent layer (not shown) is coated on the inner side of the front substrate 14.

The discharge electrodes 13 are made of one metal plate selected from a group comprising aluminum, chrome, copper and nickel. A process for fabricating the discharge electrodes 13 will now be described.

A metal plate is prepared and then the metal plate is punched to form a plurality of holes H on a predetermined position thereof by punching processes using drill. The metal plate having a plurality of holes H therein is divided into two. A dielectric layer 13*a* is formed with a thickness of several $\mu$m on the surface of the two divided metal plates by performing anodizing processes. Here, the dielectric layer 13*a* is to form so as to generate AC discharge. The pair of metal plates is fixed between the rear substrate 12 and the front substrate 14 with a predetermined distance in consideration of discharge voltage and brightness efficiency.

In order to fix the metal plates, outside sealing silicon rubbers 20 having shapes of '⊂' and '⊃' are put in on the edges of metal plates and then, the metal plates are arranged on the rear substrate 12. Finally, the part of metal plates having the outside sealing silicon rubbers are printed on the rear substrate 12 by using seal glass paste.

According to Ac type plasma display panel for back light of the present invention having the above structure, gas discharge is generated between the discharge electrodes 13 as well as the upper and lower parts of the discharge electrode in the discharge space, since the discharge electrodes 13 have a plurality of holes H providing gas flow path. Therefore, UV generation in plasma display panel for back light is increased, thereby obtaining improved discharge efficiency and brightness compared with that of convention.

As described above, according to the present invention, plasma display panel is employed as a back light of liquid crystal display device, thereby preventing pollution due to Hg. Also, gas discharge is generated between the discharge electrodes as well as on the upper and lower parts of the discharge electrode in discharge space, thereby obtaining high brightness, so that the liquid crystal display device having high quality screen be capable of realizing.

Although the preferred embodiment of this invention has been disclosed for illustrative purpose, those skilled in the art will appreciate that various modifications, additions and substitutions are possible, without departing from the scope and spirit of the invention.

What is claimed is:

1. AAC type plasma display panel for back light of liquid crystal display device comprising:

a rear substrate and a front substrate arranged opposite to each other with a predetermined distance;

seal paste for sealing the edges of the substrates;

a pair of discharge electrodes interposed between the rear substrate and the front substrate, having a plurality of holes and separated with a predetermined distance in a state of no contact with the substrates; and a plurality of spacers interposed between the rear substrate and discharge electrodes and between the front substrate and discharge electrodes in order to maintain distances.

2. The AC type plasma display panel for back light of liquid crystal display device according to claim 1, wherein the rear substrate is an aluminum substrate or a glass substrate coated a reflective film and the front substrate is a glass substrate.

3. The AC type plasma display panel for back light of liquid crystal display device according to claim 1, further comprising a fluorescent layer coated on the inner side of the front substrate.

4. The AC type plasma display panel for back light of liquid crystal display device according to claim 1, wherein the discharge electrodes are made of one metal plate selected from a group comprising aluminum, chrome, copper and nickel.

5. The AC type plasma display panel for back light of liquid crystal display device according to claim 4, wherein the fabrication process of discharge electrode comprises the steps of:

forming a plurality of holes in a metal plate by using a punching process;

dividing the metal plate having a plurality of holes into two;

forming thin dielectric layers on the surface of the divided metal plates by using an anodizing process; and fixing the metal plates between the rear substrate and the front substrate with a predetermined distance in a state of no contact with the substrates.

6. The AC type plasma display panel for back light of liquid crystal display device according to claim 5, wherein the metal plates are fixed by putting in outside sealing silicon rubbers having shapes of "⊂" and "⊃" on the edges of the metal plates and then printing the metal plates on the rear substrate.

* * * * *